US007128078B2

(12) United States Patent
Chang

(10) Patent No.: US 7,128,078 B2
(45) Date of Patent: Oct. 31, 2006

(54) TENT POLE ASSEMBLY FOR SHORING UP

(75) Inventor: Ching Tien Chang, Taipei (TW)

(73) Assignee: Goal King Co. Ltd., Hsin Tien (TW)

( * ) Notice: Subject to any disclaimer, the term of this patent is extended or adjusted under 35 U.S.C. 154(b) by 0 days.

(21) Appl. No.: 10/958,336

(22) Filed: Oct. 6, 2004

(65) Prior Publication Data

US 2006/0070647 A1 Apr. 6, 2006

(51) Int. Cl.
*E04H 15/64* (2006.01)

(52) U.S. Cl. ..... 135/114; 135/156; 135/120.3; 135/136; 403/365; 403/293

(58) Field of Classification Search ..... 135/127, 135/135–136, 114, 120.1, 120.3, 120.4, 156; 403/374, 361, 365, 368, 292, 293
See application file for complete search history.

(56) References Cited

U.S. PATENT DOCUMENTS 4,440,391 A * 4/1984 Saenz et al. ..... 482/148
5,197,504 A * 3/1993 Howe ..... 135/127
5,333,634 A * 8/1994 Taylor ..... 135/98
5,404,896 A * 4/1995 Howe ..... 135/125
5,628,336 A * 5/1997 Lee ..... 135/114
6,042,297 A * 3/2000 Lah ..... 403/348
6,286,531 B1 * 9/2001 Joo-Tai ..... 135/114
6,382,223 B1 * 5/2002 Lah ..... 135/114
6,418,952 B1 * 7/2002 Worley et al. ..... 135/120.3
6,557,572 B1 * 5/2003 Lah ..... 135/114

* cited by examiner

*Primary Examiner*—Winnie Yip
(74) *Attorney, Agent, or Firm*—Birch, Stewart, Kolasch & Birch, LLP

(57) ABSTRACT

The present invention provides a tent pole assembly for shoring up, which comprises a bottom pipe made of iron, a top pipe made of fiberglass reinforced plastic, and a connecting portion for connecting said bottom pipe and said top pipe. Said connecting portion is provided with a insertion portion and a protruding ring disposed along with exterior surface thereof. When said insertion portion inserts into one end of said bottom pipe, said protruding ring shores up said bottom pipe.

2 Claims, 6 Drawing Sheets

TENT POLE ASSEMBLY FOR SHORING UP

BACKROUNG OF THE INVENTION

1. Field of the Invention

The present invention relates to tent pole and, more particularly, to tent pole assembly for shoring up tents used by campers outdoors or children playing indoors.

2. Description of Related Art

In the past, the tent pole are usually made of iron. It makes camping become a very heavy activity. People wants to have a lighter tent, thus the tent suppliers develop tent pole of fiberglass reinforced plastic.

It is necessary for tent poles to have enough strength and elasticity, and usually fabricated with a fiberglass reinforced plastic (FRP). However, the above-mentioned tent pole made of the fiberglass-reinforced plastic is ready to be cracked when broken through carelessness or aged after long time uses. At that moment, a number of fibers are separated from the broken pole and leave such keen sections in the pole as to damage the hands or body of a user or tear the cloth of the tent.

Therefore, it develops the tent pole assembly with an FRP pipe to insert into an iron pipe. However, it has disadvantages that it is very easy to insert too deep into the iron pipe, and it is very often to cause the FRP pipe cracked.

SUMMERY OF THE INVENTION

Accordingly, an object of the present invention is to provide a tent pole assembly for shoring up protectively, used for a tent, in which the tent pole assembly for shoring up comprises a bottom pipe made of iron, a top pipe made of fiberglass reinforced plastic, and a connecting portion for connecting said bottom pipe and said top pipe. Said connecting portion is provided with a insertion portion and a protruding ring disposed along with exterior surface thereof. When said insertion portion inserts into one end of said bottom pipe, said protruding ring shores up said bottom pipe.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description and the accompanying drawings, which are given by way of illustration only, and thus are not limitative of the present invention, and in which.

DETAILED DESCRIPTION OF EXEMPLARY EMBODIMENTS

The following descriptions of the preferred embodiments are provided to understand the features of the present invention. Hereinafter, the present invention will be described in detail with reference to the accompanying drawings.

Figure 1:
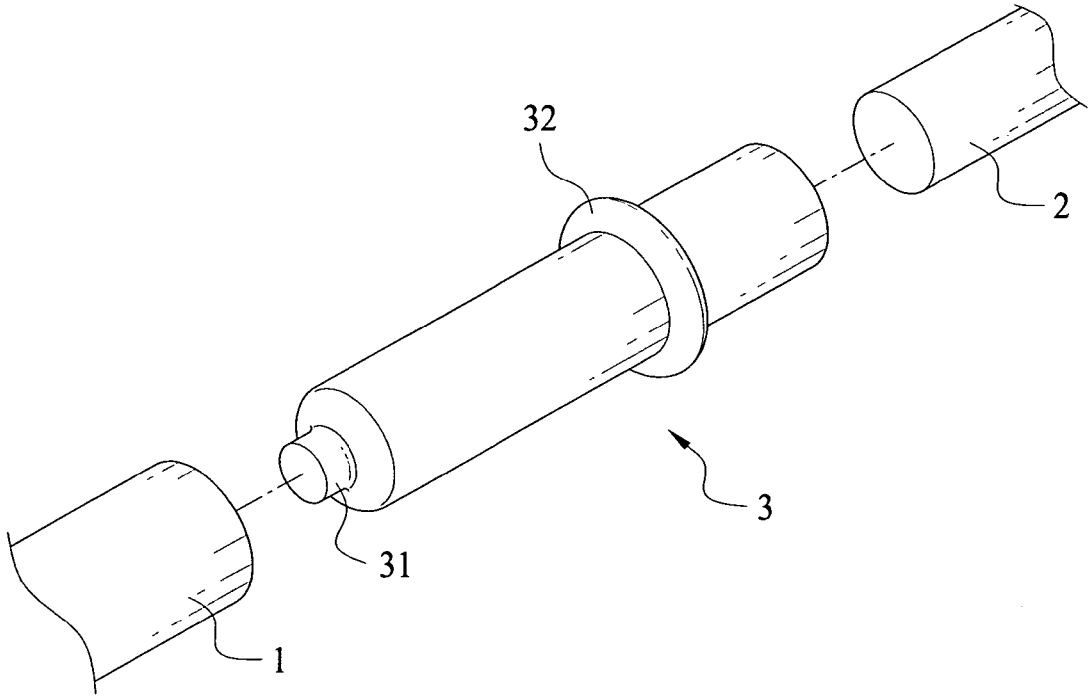
FIG. 1 is an enlarged exploded perspective view of the present invention.

Referring to FIG. 1, which is an enlarged exploded perspective view of the present invention to show a tent pole assembly for shoring up. It comprises a bottom pipe 1 made of iron, a top pipe 2 made of fiberglass reinforced plastic (FRP) for providing elastic bending force, and a connecting portion 3 for connecting said bottom pipe 1 and said top pipe 2.

The connecting portion 3 includes a insertion portion 31 having a smaller diameter than said top pipe 2, therefore, when said top pipe 2 insert into said connecting portion 3, the insertion portion 31 may shore up the top pipe 2.

More particularly, one feature of the present invention is a protruding ring 32 disposed along with exterior surface of said connection portion 3. Whenever said insertion portion 31 is adapted to insert into one end of said bottom pipe 1, said protruding ring 32 shores up said bottom pipe 1.

Figure 2:
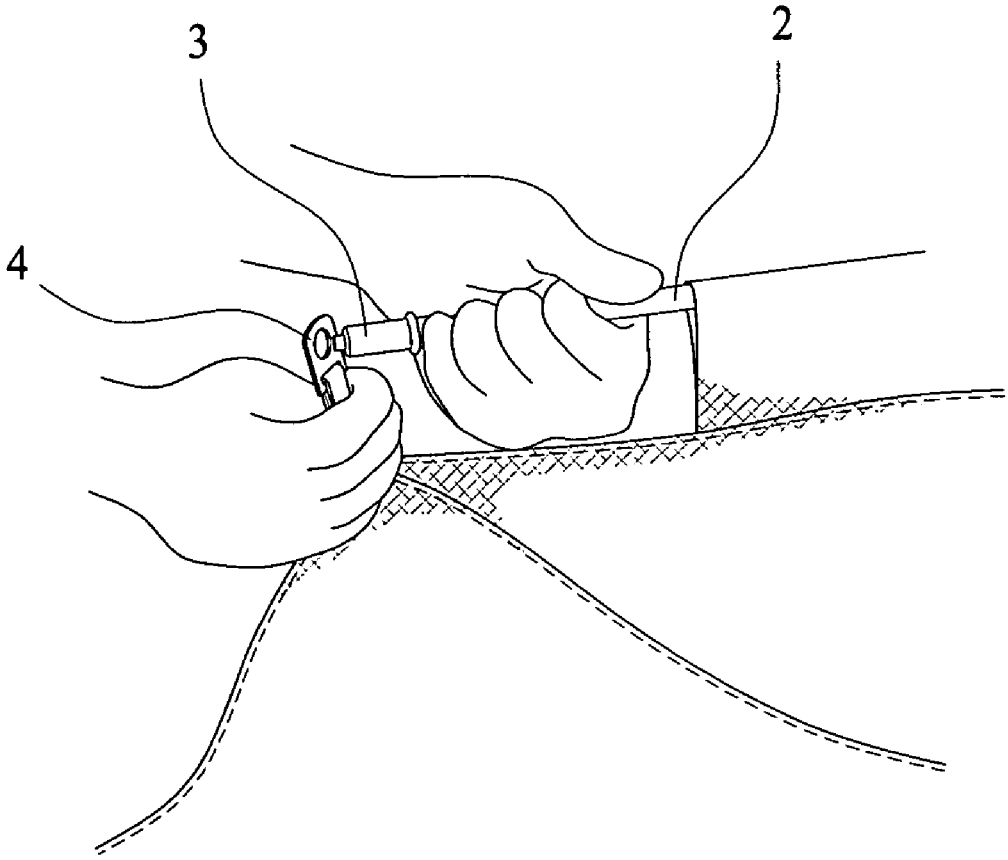
FIG. 2 and FIG. 3 illustrate the assembly process of the present invention.
Figure 3:
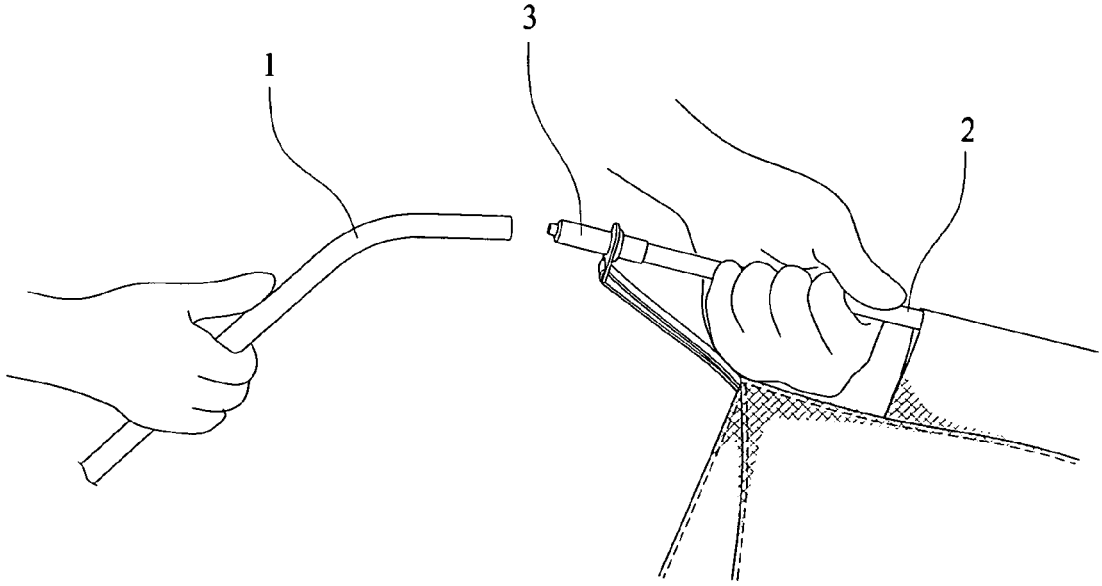
Figure 4:
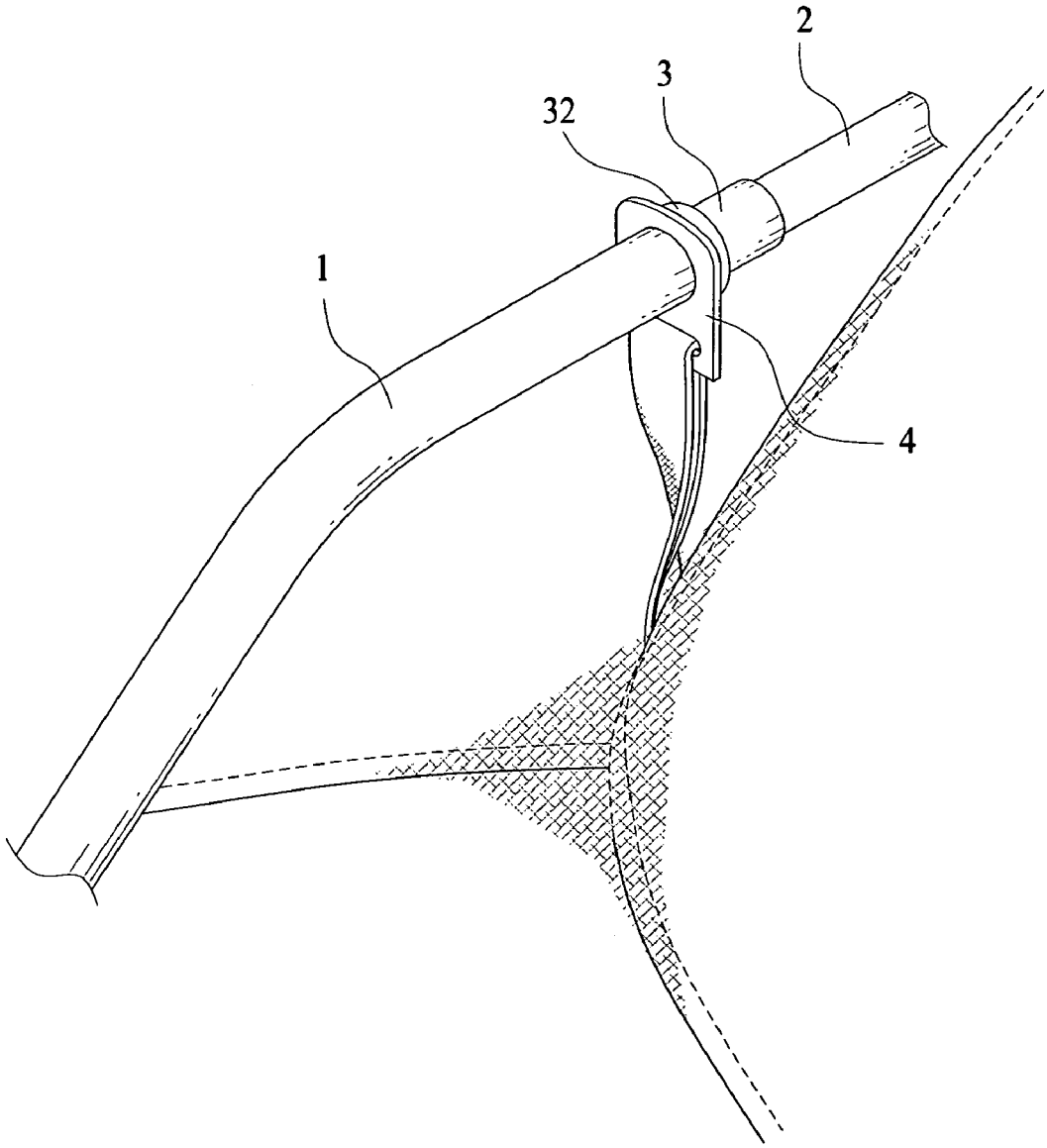
FIG. 4 illustrates an enlarged perspective view of the present invention

The diameter of the bottom pipe 1 is smaller than the diameter of the protruding ring 32, thus, when the bottom pipe 1 is inserted into the protruding ring 32, the protruding ring 32 shores up the bottom pipe 1. And because the insertion portion 31 is provided with a smaller diameter than the diameter of the top pipe 2, therefore, when said top pipe 2 insert into said connection portion 3, the insertion portion 31 may shore up the top pipe 2. Refering to FIG. 2, when assembling a tent, said top pipe 2 has inserted into said connecting portion 3 first, and then, a buckle ring 4 connecting with a tent main body wears on said connecting portion 3, as shown in FIG. 3. Next, put said bottom pipe 1 on said connecting portion 3, thus, as shown in FIG. 4, said buckle ring 4 is disposed between said bottom pipe 1 and said protruding ring 32 for fixing and shoring up said tent main body.

Therefore, due to the connection portion 3 connects the top pipe 2 and bottom pipe 1, the top pipe 2 of fiberglass reinforced plastic will not be so easy to crack because of inserting too deep into the bottom pipe 1. And also because of the enhancement of said buckle ring fixed between said bottom pipe 1 and said protruding ring 32, the tent is assembled more firm.

Figure 5:
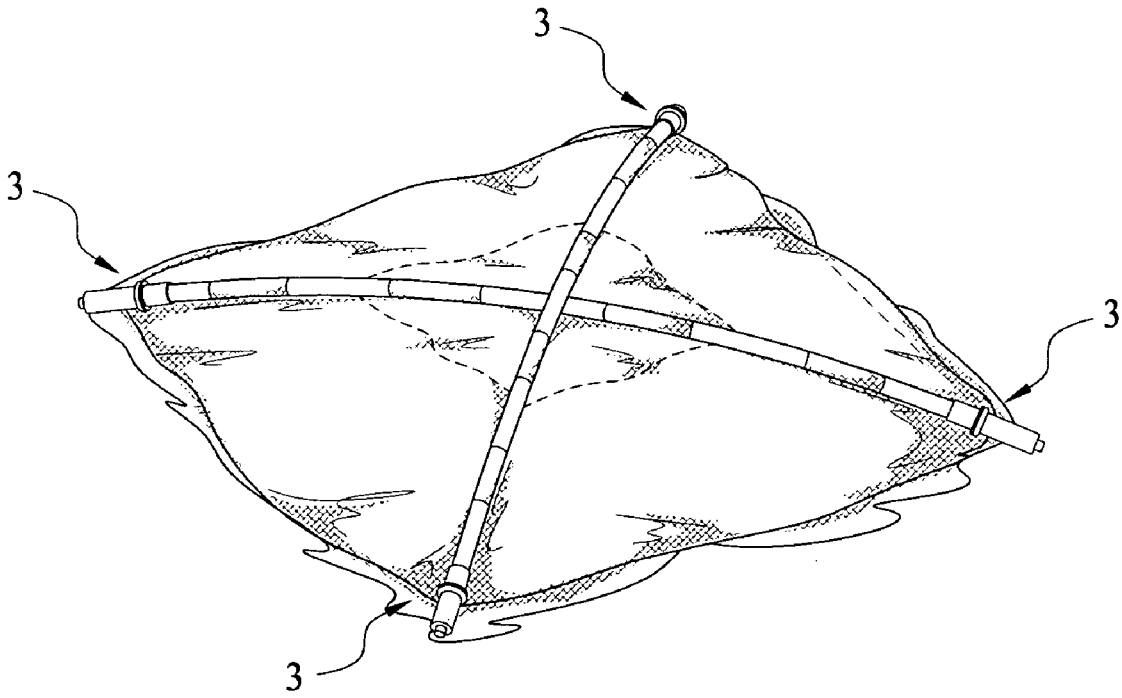
FIG. 5 is an illustrative diagram showing a position that the present invention is in use to be formed with a tent.
Figure 6:
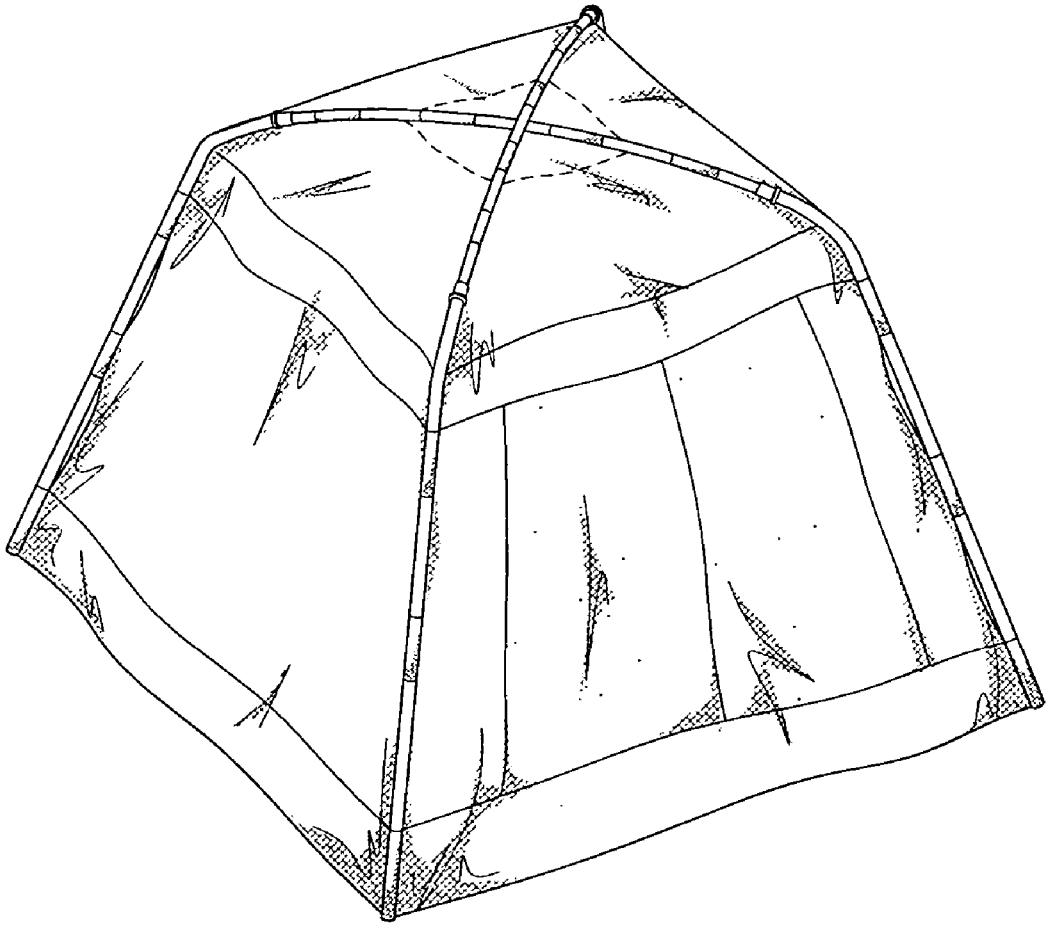
FIG. 6 is an illustrative diagram showing a position that the present invention is in use forming a tent.

After a plurality of top pipes 2 propping up a tent, as shown in FIG. 5, the feature of fiberglass reinforced plastic (FRP) may provide a elastic bending force. Provided with the connection portion 3 to connect the top pipes in one end, and inserted into bottom pipes 1 in another end of the connection portion 3, the tent may be propped up to form a tent (such like a yurt), as shown in FIG. 6. Thus, it is very easy to assemble a tent according to the present invention, especially, it is possible to be down by only one person when assembling.

The present invention may be embodied in other specific forms without departing from the spirit of the essential attributes thereof; therefore, the illustrated embodiment should be considered in all respects as illustrative and not restrictive, reference being made to the appended claims rather than to the foregoing description to indicate the scope of the invention.

What is claimed is:

1. A tent pole assembly for shoring up a tent, comprising:

a bottom pipe made of iron;

a top pipe made of fiberglass reinforced plastic;

a connecting portion connecting said bottom pipe and said top pipe, said connecting portion having an upper portion receiving one end of the top pipe, a insertion portion and a protruding ring disposed along with an exterior surface of said connecting portion and disposed in between said upper portion and said insertion portion, said insertion portion being inserted into one end of said bottom pipe, and said protruding ring shoring up said bottom pipe; and a buckle ring connecting with a tent main body, said buckle ring being disposed on said exterior surface of said connecting portion and engaged between said bottom pipe and said protruding ring for fixing and shoring up said tent main body.

2. The tent pole assembly as in claim 1, wherein said insertion portion having a smaller diameter than said top pipe.

* * * * *